US009279642B2

(12) United States Patent
Rowlett et al.

(10) Patent No.: US 9,279,642 B2
(45) Date of Patent: Mar. 8, 2016

(54) PORTABLE MULTI-USE SELF-DEFENSE DEVICE

(71) Applicant: Larry D. Rowlett, Ridgeland, MS (US)

(72) Inventors: Larry D. Rowlett, Ridgeland, MS (US); Anthony Foster, Brookhaven, MS (US)

(73) Assignee: Larry D. Rowlett, Ridgeland, MS (US)

( * ) Notice: Subject to any disclaimer, the term of this patent is extended or adjusted under 35 U.S.C. 154(b) by 0 days.

(21) Appl. No.: 14/218,232

(22) Filed: Mar. 18, 2014

(65) Prior Publication Data

US 2014/0263445 A1 Sep. 18, 2014

Related U.S. Application Data

(60) Provisional application No. 61/790,125, filed on Mar. 15, 2013.

(51) Int. Cl.
*F41H 9/10* (2006.01)

(52) U.S. Cl.
CPC ..... *F41H 9/10* (2013.01)

(58) Field of Classification Search
CPC ..... F41H 9/10
USPC ..... 222/113, 136, 135, 402.15, 162, 192, 222/79, 39, 394, 471, 470, 482, 325; 251/254, 279
See application file for complete search history.

(56) References Cited

U.S. PATENT DOCUMENTS 2,424,045 A * 7/1947 Millstein ..... 446/76
2,629,516 A * 2/1953 Badham ..... 222/79
3,069,097 A * 12/1962 Cheney ..... 239/338
3,438,547 A * 4/1969 Pereida et al. ..... 222/79
3,534,890 A * 10/1970 Iannacone ..... 222/402.14
3,568,892 A * 3/1971 Burk ..... 222/327
3,635,372 A * 1/1972 Van Dyck et al. ..... 222/3
3,635,374 A * 1/1972 Anketell ..... 222/78
3,638,836 A * 2/1972 Vickers, III ..... 222/113
3,716,170 A * 2/1973 Mangels ..... 222/162
3,776,429 A * 12/1973 DeLucia ..... 222/162
3,967,757 A * 7/1976 Fegley ..... 222/5
4,018,361 A * 4/1977 Fegley ..... 222/5
4,186,851 A * 2/1980 Cantor ..... 222/113
4,223,804 A * 9/1980 Morris et al. ..... 222/3
4,247,844 A * 1/1981 Zapolski et al. ..... 340/321
4,301,946 A * 11/1981 Goldin et al. ..... 222/113
4,792,062 A * 12/1988 Goncalves ..... 222/135
4,971,257 A * 11/1990 Birge ..... 239/708
5,169,029 A * 12/1992 Behar et al. ..... 222/1
5,226,563 A * 7/1993 Coggiola ..... 222/95
5,331,523 A * 7/1994 Delzer ..... 362/96
5,344,051 A * 9/1994 Brown ..... 222/135
5,373,427 A * 12/1994 McLean ..... 362/96
5,397,029 A * 3/1995 West ..... 222/79
5,420,766 A * 5/1995 Hollis ..... 362/96
5,446,985 A * 9/1995 Chen ..... 42/1.08
5,476,192 A * 12/1995 Julinot ..... 222/78
5,549,220 A * 8/1996 Whalen ..... 222/1

(Continued)

*Primary Examiner* — Kevin P Shaver
*Assistant Examiner* — Michael J Melaragno
(74) *Attorney, Agent, or Firm* — Maier & Maier, PLLC

(57) ABSTRACT

The portable multi-use self-defense device can include a trigger; a housing; two or more canisters, said canisters containing at least one of gas and liquids; and an engagement mechanism coupled to said trigger and to said canisters, said engagement mechanism being capable of actuating the discharge of the at least one of gas and liquids from the two or more canisters substantially simultaneously.

14 Claims, 10 Drawing Sheets

(56) References Cited

U.S. PATENT DOCUMENTS

| | | | | |
|---|---|---|---|---|
| 5,556,003 | A * | 9/1996 | Johnson et al. | 222/39 |
| 5,570,817 | A * | 11/1996 | Anderson et al. | 222/153.11 |
| 5,673,819 | A * | 10/1997 | Brunswig | 222/113 |
| 5,683,168 | A * | 11/1997 | Teig et al. | 362/96 |
| 5,875,926 | A * | 3/1999 | Schwartz | 222/79 |
| 5,887,550 | A * | 3/1999 | Levine et al. | 119/796 |
| 5,893,483 | A * | 4/1999 | Duran | 222/39 |
| 5,901,881 | A * | 5/1999 | Wang | 222/113 |
| 5,904,273 | A * | 5/1999 | Aspacher et al. | 222/402.15 |
| 5,924,599 | A * | 7/1999 | Brown | 222/135 |
| 5,988,450 | A * | 11/1999 | Cassarino | 222/192 |
| 6,052,051 | A * | 4/2000 | Whalen | 340/425.5 |
| 6,173,870 | B1 * | 1/2001 | Taylor | 222/402.15 |
| 6,196,419 | B1 * | 3/2001 | Haney et al. | 222/79 |
| 6,834,778 | B2 * | 12/2004 | Jinbo et al. | 222/135 |
| 6,860,411 | B2 * | 3/2005 | Stradella | 222/321.8 |
| 7,100,602 | B2 * | 9/2006 | Cole et al. | 128/200.14 |
| 7,121,432 | B2 * | 10/2006 | Kostal et al. | 222/192 |
| 7,308,993 | B2 * | 12/2007 | Mineau | 222/182 |
| 7,370,600 | B2 * | 5/2008 | Tomassetti et al. | 116/3 |
| 7,497,354 | B2 * | 3/2009 | Decottignies et al. | 222/135 |
| 8,052,015 | B2 * | 11/2011 | Huang | 222/402.15 |
| 8,056,765 | B2 * | 11/2011 | Auerbach et al. | 222/162 |
| 8,511,515 | B2 * | 8/2013 | Lemaner | 222/162 |
| 8,596,266 | B2 * | 12/2013 | Eberhard | 128/200.23 |
| 8,690,020 | B1 * | 4/2014 | Murray | 222/192 |
| 2002/0108966 | A1 * | 8/2002 | Park | 222/113 |
| 2004/0046669 | A1 * | 3/2004 | Chiapperini | 340/574 |
| 2004/0188471 | A1 * | 9/2004 | Cellini et al. | 222/192 |
| 2004/0238567 | A1 * | 12/2004 | Bloc | 222/135 |
| 2006/0201964 | A1 * | 9/2006 | DiPerna et al. | 222/78 |
| 2007/0108231 | A1 * | 5/2007 | Gray et al. | 222/135 |
| 2007/0119877 | A1 * | 5/2007 | Weltzin | 222/451 |
| 2007/0194048 | A1 * | 8/2007 | Teig | 222/113 |
| 2007/0205223 | A1 * | 9/2007 | Hansen | 222/192 |
| 2008/0158859 | A1 * | 7/2008 | McMeekin et al. | 362/96 |
| 2008/0245818 | A1 * | 10/2008 | Strickland | 222/113 |
| 2009/0127283 | A1 * | 5/2009 | Smith et al. | 222/25 |
| 2010/0025427 | A1 * | 2/2010 | Chiou et al. | 222/1 |
| 2010/0237098 | A1 * | 9/2010 | Kaufman | 222/113 |
| 2010/0269762 | A1 * | 10/2010 | Johnson | 119/712 |
| 2011/0049188 | A1 * | 3/2011 | Parisi et al. | 222/162 |
| 2011/0210146 | A1 * | 9/2011 | Dapper | 222/113 |
| 2012/0292337 | A1 * | 11/2012 | Becker | 222/1 |
| 2013/0026187 | A1 * | 1/2013 | Kim | 222/153.13 |
| 2013/0161351 | A1 * | 6/2013 | Eini et al. | 222/135 |
| 2014/0061239 | A1 * | 3/2014 | Brugger | 222/135 |
| 2014/0252036 | A1 * | 9/2014 | Ballard | 222/113 |

* cited by examiner

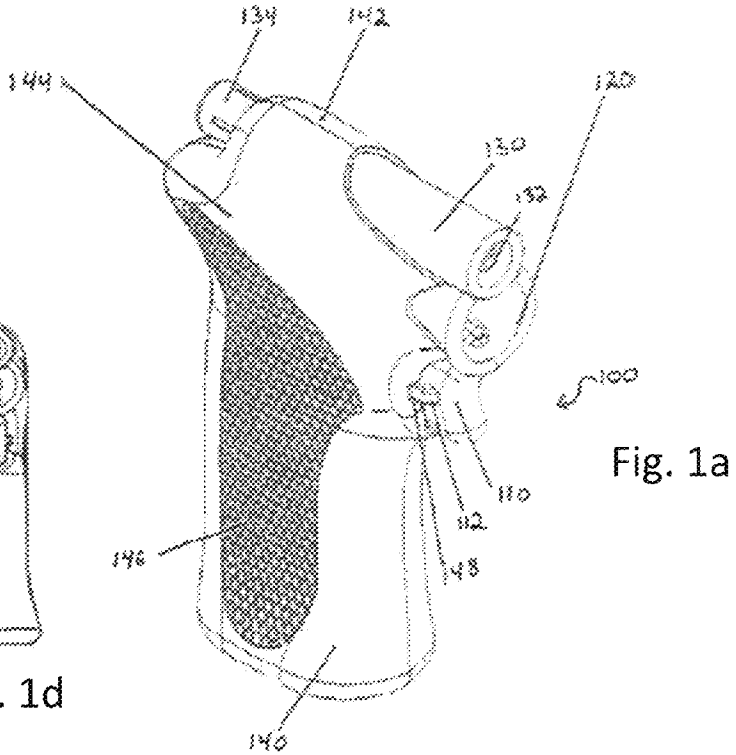
Fig. 1a
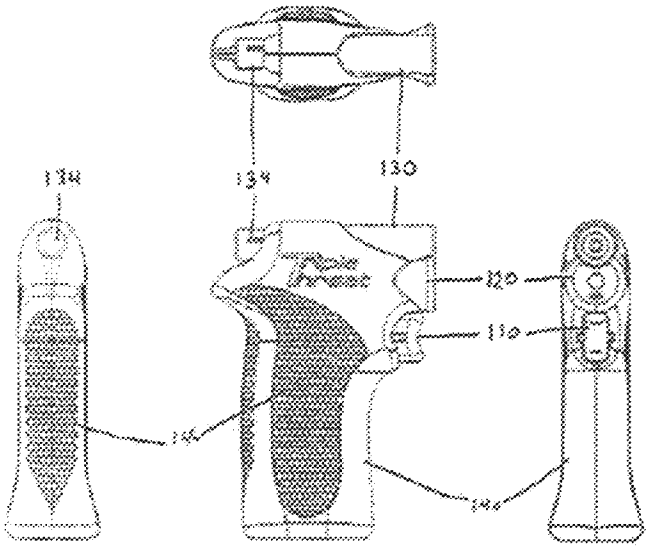
Fig. 1d
Fig. 1c
Fig. 1e
Fig. 1b

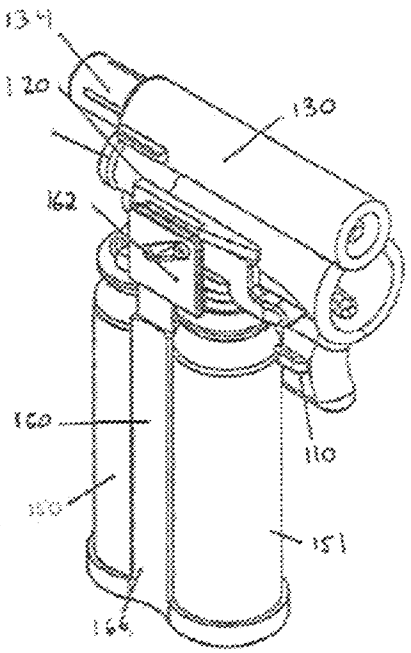
Fig. 2a
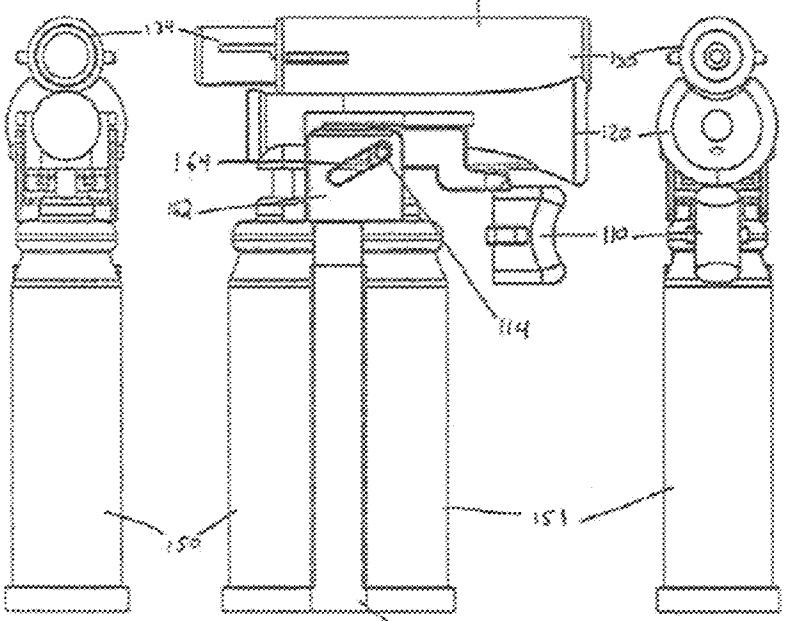
Fig. 2d
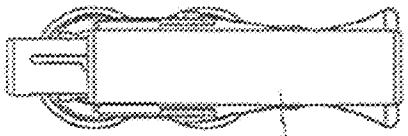
Fig. 2e
Fig. 2c
Fig. 2b 15
15a
14
11a

PORTABLE MULTI-USE SELF-DEFENSE DEVICE

CROSS-REFERENCE TO RELATED APPLICATIONS

This application claims priority to U.S. Provisional Patent Application No. 61/790,125, filed Mar. 15, 2013 and entitled PORTABLE MULTI-USE SELF-DEFENSE DEVICE, the entire contents of which are hereby incorporated by reference.

BACKGROUND

Conventional self-defense devices use a single system or combination of systems to deter potential assailants. The systems utilizing a combination of systems have different mechanisms for activating each system. Valuable time may be wasted in preparing to use one of the systems on a device. For example, a user may have to push multiple buttons on different ends a device to enable both systems at once. The elimination of this wasted time may mean the difference between safely avoiding a dangerous situation. Therefore, a device that incorporates time-saving features is needed to provide a safer self-defense device.

SUMMARY

A portable multi-use self-defense device. The portable multi-use self-defense device can include a trigger; a housing; two or more canisters, said canisters containing at least one of gas and liquids; and an engagement mechanism coupled to said trigger and to said canisters, said engagement mechanism being capable of actuating the discharge of the at least one of gas and liquids from the two or more canisters substantially simultaneously.

BRIEF DESCRIPTION OF THE FIGURES

FIG. 1*a* is a perspective view of a multi-use device.
FIG. 1*b* is a side elevation of a multi-use device.
FIG. 1*c* is a front elevation of a multi-use device.
FIG. 1*d* is a rear elevation of a multi-use device.
FIG. 1*e* is a top elevation of a multi-use device.
FIG. 2*a* is a perspective view of the interior of a multi-use device.
FIG. 2*b* is a side elevation of the interior of a multi-use device
FIG. 2*c* is a front elevation of the interior of a multi-use device.
FIG. 2*d* is a rear elevation of the interior of a multi-use device.
FIG. 2*e* is a top elevation of the interior of a multi-use device.

DETAILED DESCRIPTION

Figure 3:
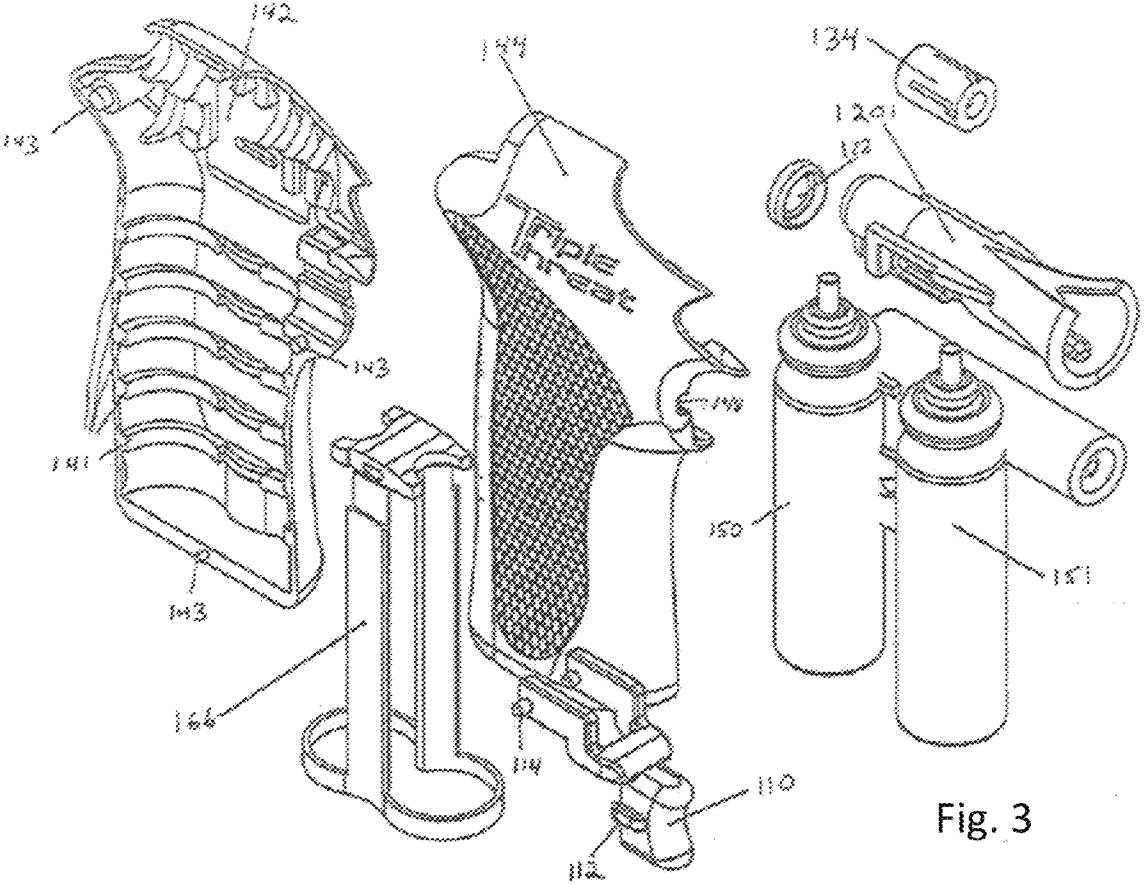
FIG. 3 is an exploded view of a multi-use device.

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to the accompanying drawings, the device may be formed in any of a variety of manners and may be used in any of a variety of situations. An exemplary embodiment may appear similar to device 100, although other forms and designs are envisioned. An exemplary situation where the device might be used is as a defensive measure in a threatening situation from an assailant. The use of the device may not be limited to humans, but could also be used to defend against attacks by animals or any other form of attack or situation, as desired.

As shown in exemplary FIG. 1*a-e*, device 100 may include a trigger 110, a barrel 120, a light system 130, and a housing 140. These and other portions of device 100 can be further shown and described in the following figures.

Device 100 may include a trigger 110. Trigger 110 may be shaped to be used by a user's finger, or in any other fashion, as desired. Moreover, trigger 110 may be a polymer, metal, or any other suitable material. Trigger 110 may include a sliding bar 112. Sliding bar 112 may be shaped to substantially fit into trigger slot 148 in housing 140. Trigger slot 148 may be aligned so as to allow trigger 110 to move in substantially a front-back direction.

Barrel 120 may be located above trigger 110 and below light system 130, with the exit of barrel 120 facing distally from the user. Barrel 120 may be made of a metal or any other suitable material as desired and may be substantially cylindrical. Also, barrel 120 may be substantially hollow. The radius of barrel 120 may, starting from the proximate end and moving distally, gradually increase in diameter, for example in a fluted fashion. Barrel 120 may include one or more nozzles located on the distal end. Referring to FIG. 3, in one exemplary embodiment barrel 120 may include a barrel cap 122.

Light system 130 may be located on the top of device 100. As shown, light system 130 may be partially encased within housing 140 of device 100. Additionally, light system 130 may be substantially wholly encased with housing 140. Lamp 132 of light system 130 may be directed distally, while a control switch 134 of light system 130 may be located proximately. Light system 130 may be substantially cylindrical in shape or any other shape as desired. Furthermore, the distal end of light system 130 may extend approximately to the end of the distal end of device 100. The bottom side of light system 130 may be housed within a portion of barrel 120 formed as a substantially identical crescent shape to match and receive the curvature of light system 130. Control switch 134 may extend partially out from housing 140, allowing a user to activate light system 130 by, but not limited to, depression of control switch 134 or rotation of control switch 134. Control switch 134 may include the ability to check the operability of light system 130, including but not limited to, the energizing source, such as a battery, and lamp 132. Alternatively, light system 130 may be activated by depressing trigger 110. In addition, lamp 132 may be removable and there may be an opaque or transparent piece of impact resistant material such as but not limited to a polymer in front of lamp 132 for protection. Activation of light system 130 may include, but is not limited to, emitting a substantially bright and blinding light from lamp 132 powerful enough to disorient an assailant. Additionally, light system 130 may include the potential to draw attention to the user to aid in rescue efforts.

Within the housing of light system 130 may be situated an energizing source, such as a battery, for lamp 132 of light system 130. This energizing source may function and be connected in any known manner. In one embodiment, the energizing source may be connected to one end of control switch 134 through a conducting wire. A second conducting wire may extend between lamp 132 and control switch 134. Upon activation of control switch 134, the two conducting wires may sufficiently come into contact with each other to complete an electrical circuit between the energizing source and lamp 132. Furthermore, the energizing source may be removable or fixed into the housing 140 or light system 130 and may be rechargeable or single-use, as desired.

Housing 140 may be made of any material or combination of materials as desired, for example individualized pieces of molded, machined or otherwise formed plastic. However, the components or pieces may also be formed of metal or other suitable material. Housing 140 may have a left side 142 and a right side 144. These two sides may be fastened by any known manner including, but not limited to, adhesives, screws, or bolts. Housing 140 may also include a grip 146. Grip 146 may be located behind or below trigger 110 and may be shaped to fit the palm of a hand, for example to be ergonomically comfortable, or in any other fashion, as desired. Additionally grip 146 may be a polymer or any other suitable material. Referring to exemplary FIG. 3, housing 140 may include a plurality of ribs 141 which may be shaped to substantially fit a cylindrical canister. Further, left side 142 of housing 140 may include one or more anchoring pins 143. Anchoring pins 143 may be fastened in any manner known in the art, including but not limited to, welding or an adhesive. Anchoring pins 143 may assist in the combination or fastening of left side 142 and right side 144. Anchoring pins 143 may further provide load bearing support for device 100.

Referring to exemplary FIG. 2*a-e* and FIG. 3, device 100 may include a plurality of canisters 150, 151 filled with, but not limited to, liquid or air. These canisters 150, 151 may be substantially cylindrical and may taper as they move longitudinally from a base to a seal. Furthermore, the base of canisters 150, 151 may be flat or formed in any desired shape. Additionally, canisters 150, 151 may be any known off-the-shelf or commonly available canister used for pepper spray or air horns. In a non-limiting example, these canisters 150, 151 may be pressurized such that their contents could be expelled from barrel 120 with such force as to reach an advancing assailant, similar to that of known compressed air or pepper spray devices. In an additional non-limiting example, the contents of at least one of canisters 150, 151 may include pepper spray that is dyed orange.

Device 100 may also include an engagement mechanism 160. Components of engagement mechanism 160 may be metal, rigid plastic, or any other suitable material. Engagement mechanism may further be comprised of a plate 162 and pull up 166. Trigger 110 may functionally engage with canisters 150, 151 through engagement mechanism 160. Trigger may include slide pin 114 which is shaped to substantially fit into slide slot 164 of plate 162. Slide slot 164 may be on a diagonal angle such that when trigger 110 is moved back, slide pin 114 moving through slide slot 164 causes plate 162 to move in a substantially upward motion. Plate 162 may further be coupled to pull up 166. Pull up 166 may be shaped to substantially fit and couple to canisters 150 in such a way that when plate 162 moves in a substantially upward motion, thereby causing pull up 166 to move in a substantially upward motion, it also causes canisters 150, 151 housed therein to move in a substantially upward motion.

Figure 4:
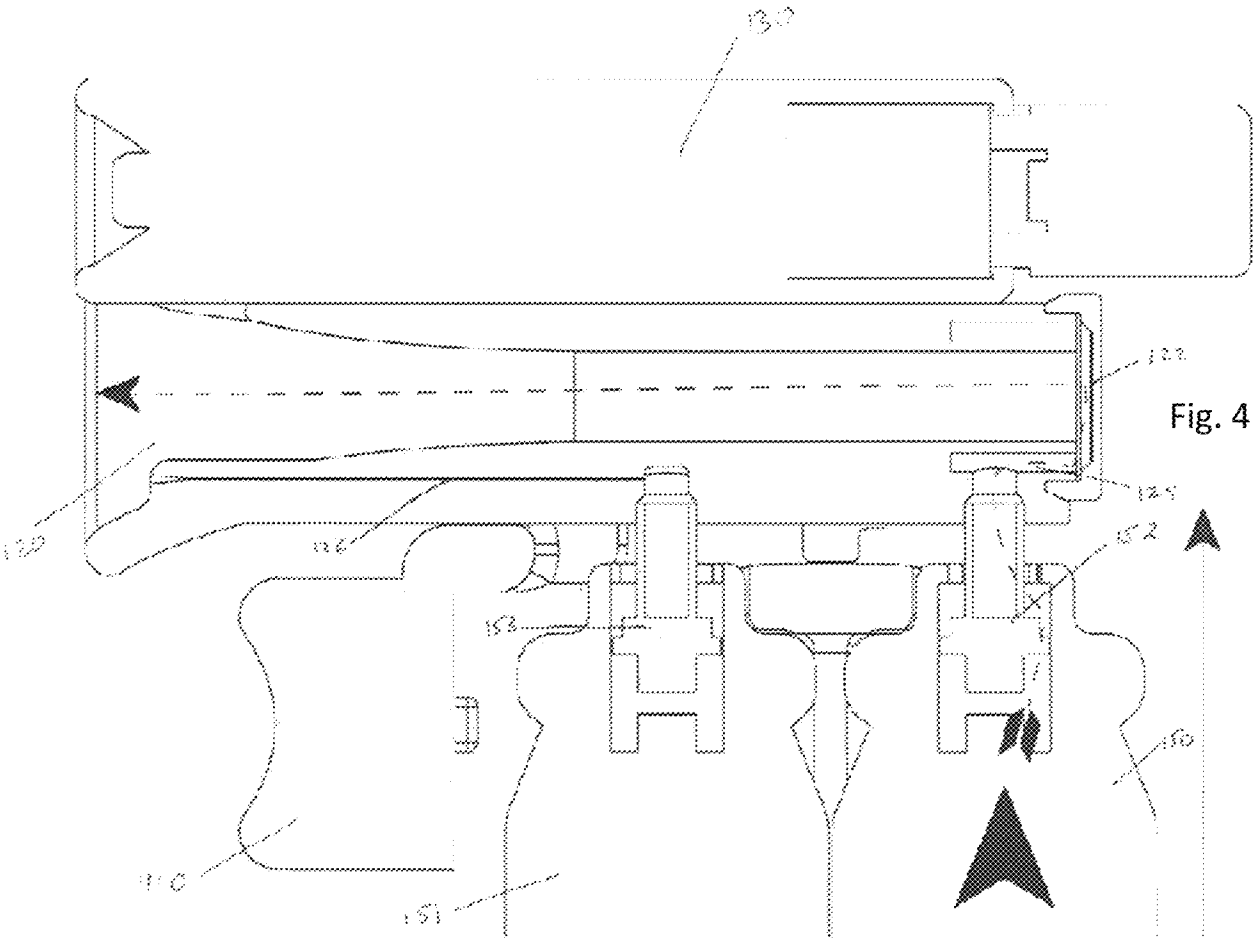
FIG. 4 is an exemplary cutaway view of a multi-use device.
Figure 5:
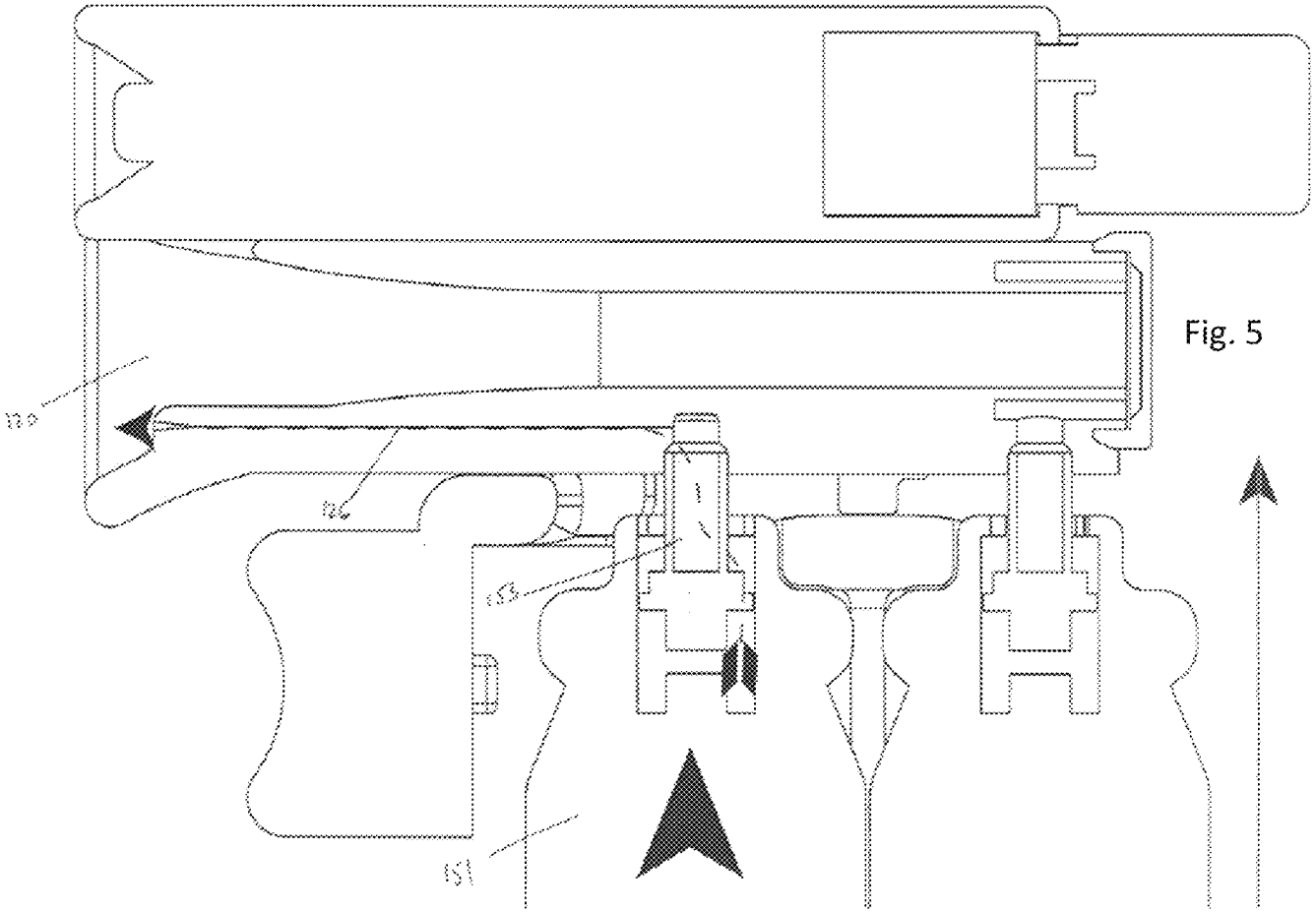
FIG. 5 is an exemplary cutaway view of a multi-use device.
Figure 6:
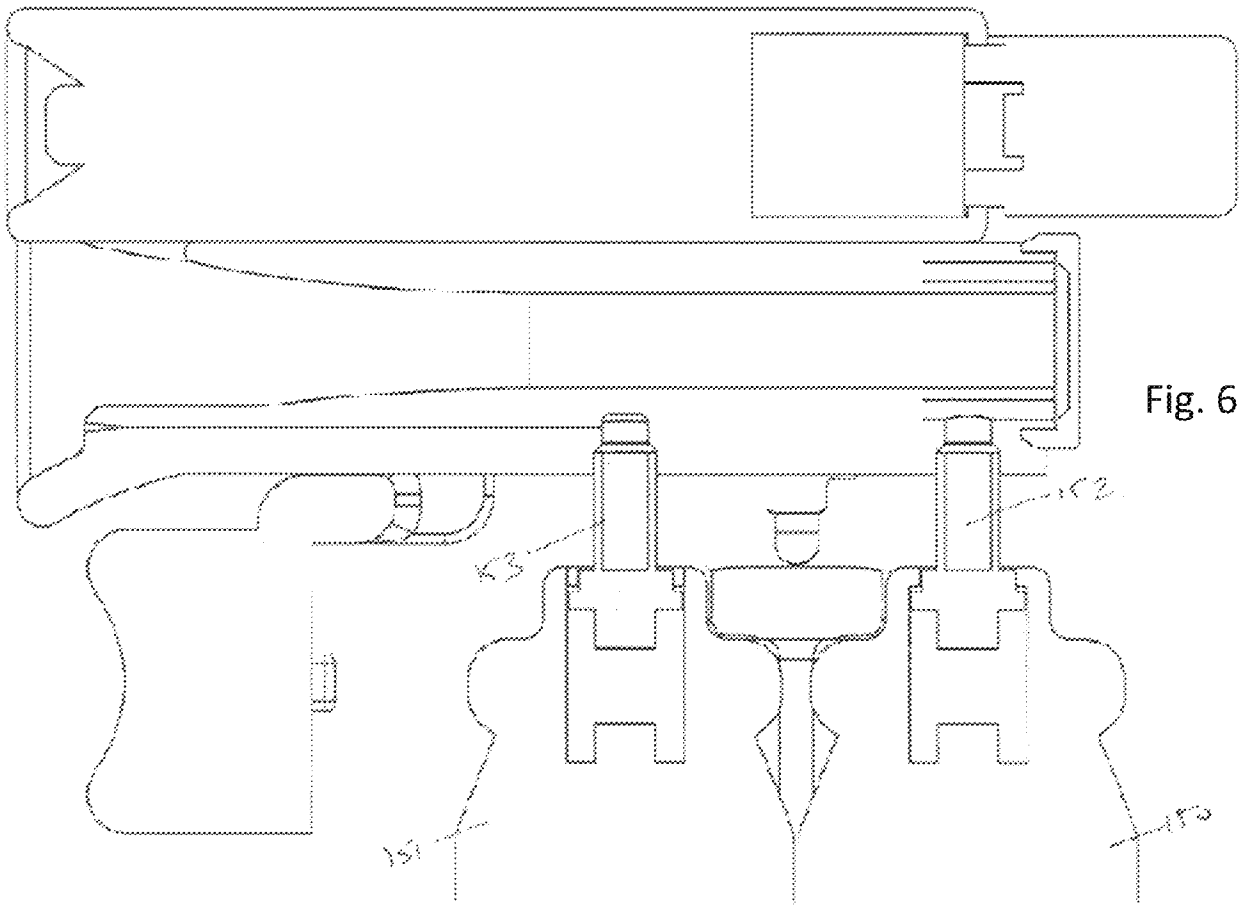
FIG. 6 is an exemplary cutaway view of a multi-use device.

Referring generally to both the figures described above, as well as FIGS. 4-6, canister 150 may include valve 152. Valve 152 may facilitate the release of the contents of canister 150 upon compression facilitated by pull up 166. Valve 152 may be received by intake feed 124, which may be located substantially on the near side of the bottom of barrel 120. Intake feed 124 may be substantially hollow, allowing contents of canister 150 to flow into barrel 120. Further, canister 151 may include valve 153. Valve 153 may facilitate the release of the contents of canister 151 upon compression facilitated by pull up 166. Valve 153 may be received by expulsion line 126, which may be located on the bottom of barrel 120. Expulsion line 126 may be substantially hollow allowing contents of canister 151 to flow through barrel 120 and expelled distally. The distance between intake feed 124 and expulsion line 126 may be sufficient to accommodate canisters 150, 151. Valves 152, 153 may function such that when not compressed by pull up 166, valves 152, 153 substantially seal canisters 150, 151 such that the contents may not be expelled.

Figure 7:
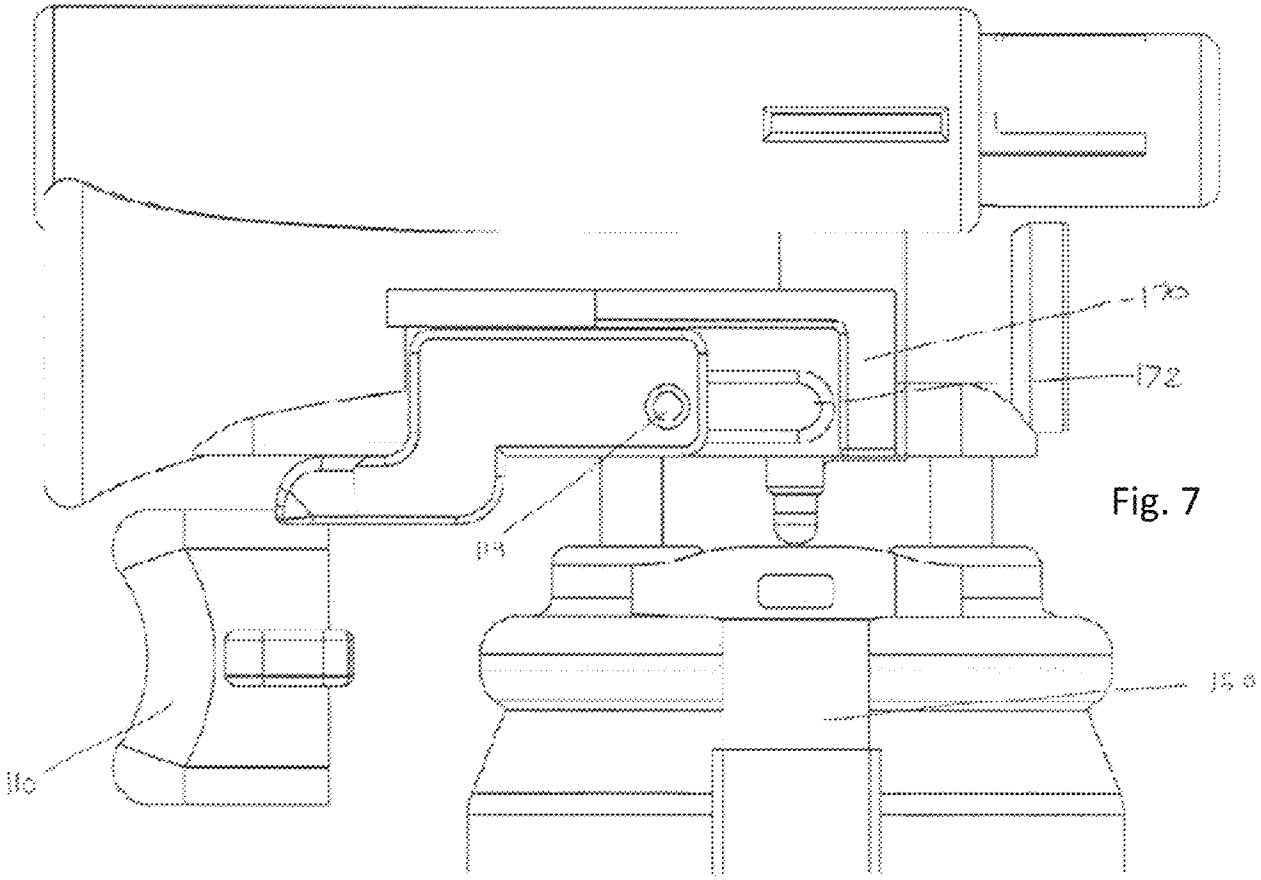
FIG. 7 is an exemplary cutaway view of a multi-use device.

In one exemplary embodiment, referring generally to both the figures already described above as well as exemplary FIG. 7, device 100 may include trigger slide 170. Trigger slide may be metal or any other suitable material. Trigger slide may be rigidly coupled to the bottom of barrel 120. Trigger side 170 may further include slot 172. Slot 172 may be oriented substantially horizontally and may be sized to properly fit slide pin 114. Further, slot 172 may be substantially parallel to trigger slot 148 to facilitate a substantially back-and-forth range of motion for trigger 110. When trigger 110 is depressed, slide pin 114 may move within slot 172 and slide slot 164 substantially simultaneously, thereby causing engagement mechanism 160 to move substantially vertically relative to trigger slide 170.

Figure 8:
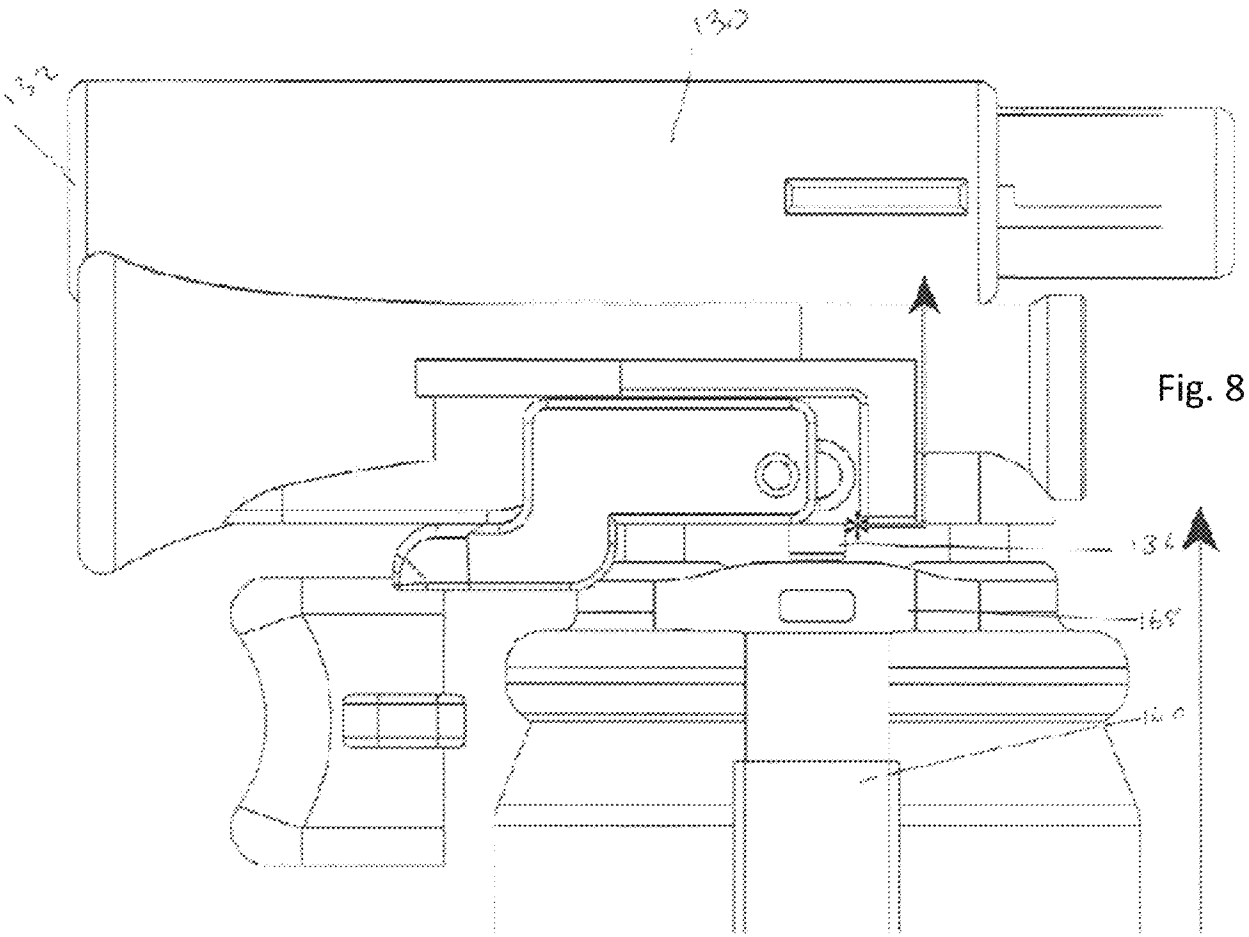
FIG. 8 is an exemplary cutaway view of a multi-use device.

In a further exemplary embodiment, referring to FIG. 8, engagement mechanism 160 may include cross-bar 168, coupled to the top of pull up 166. Further, light button 136 may be coupled to the underside of barrel 120. Light button 136 may be located in such a fashion so that when pull up 166 moves vertically, cross bar 168 pushes against and activates light button 136. Further, light button 136 may be configured so that when it is activated, it may send a signal to light system 130, activating lamp 132.

In the use of device 100, it is envisioned that a user may aim the far end of barrel 120 at an assailant and depress trigger 110. Engagement mechanism 160 may then engage with trigger 110 to move canisters 150, 151 in a substantially upward motion, causing valves 152, 153 to release the contents of canisters 150, 151, which may then flow through barrel 120 toward the assailant. At substantially the same time, user may activate light system 130 which may shine a substantially bright or blinding light toward the assailant.

Figure 9:
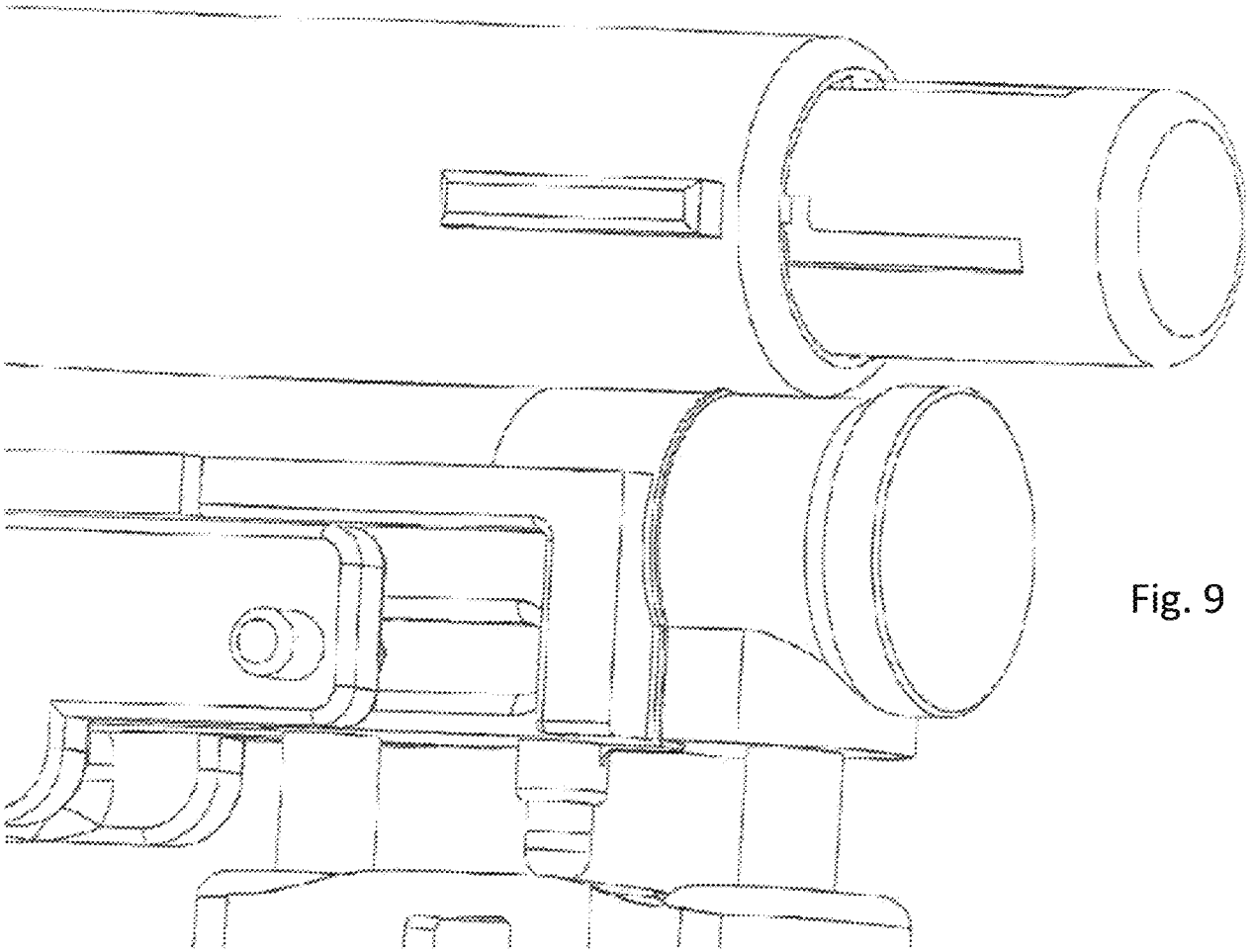
FIG. 9 is an exemplary cutaway view of a multi-use device.
Figure 10:
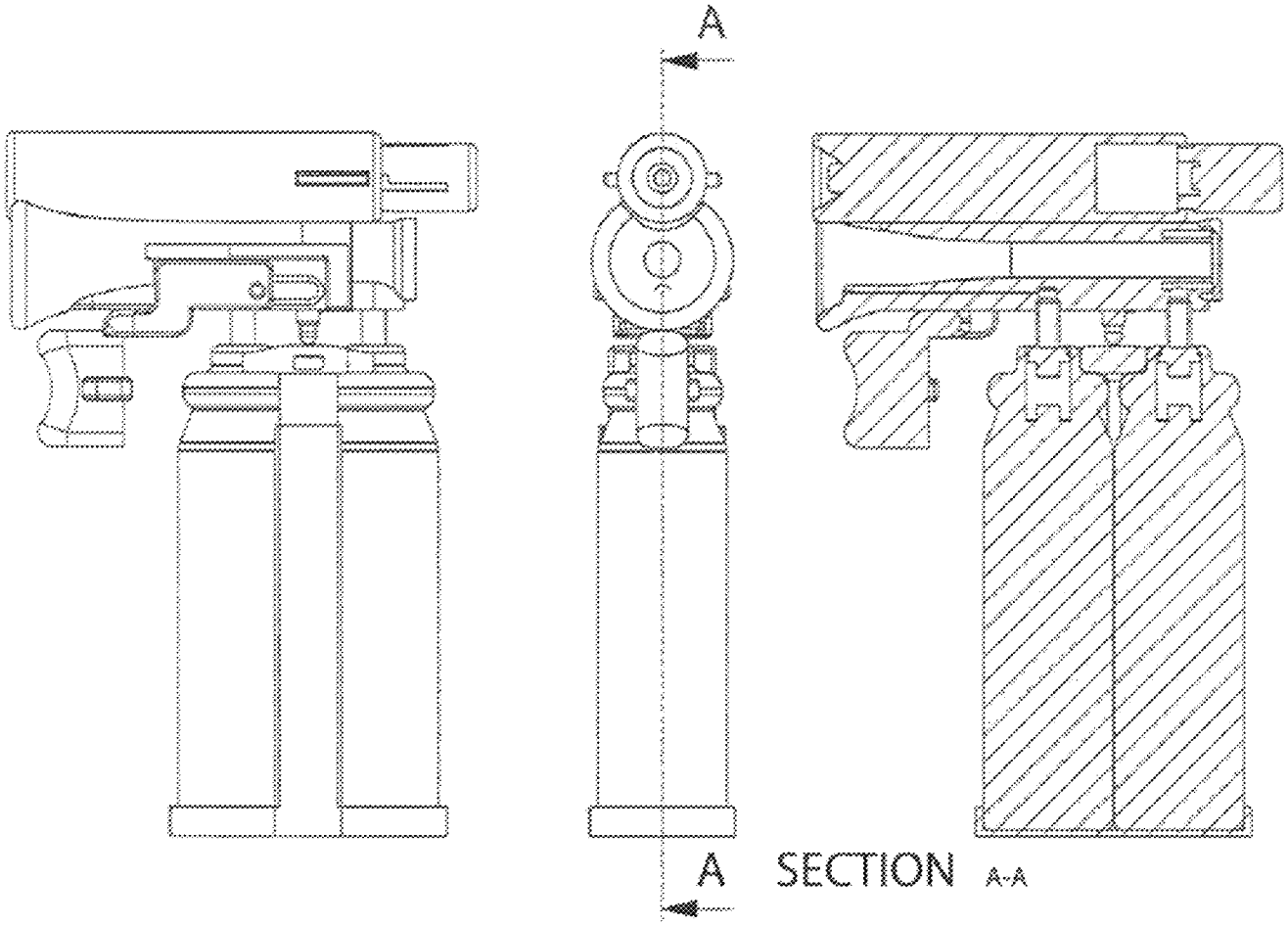
FIG. 10 provides exemplary profile and front views of a multi-use device.

Further exemplary embodiments may relate to both the figures described above, as well as exemplary FIGS. 9-10. Such examples can include any of a variety of the following features.

A safety button may be located anywhere on device 100. The safety button may be shaped in any desired fashion, and maybe a polymer or any other suitable material. Further, the safety button may be depressed with the palm of a hand or with a finger or in any other fashion, deactivating the safety system allowing trigger 110 to be depressed.

In further exemplary embodiments, an intake bracket may be situated below the intakes and above canisters 150, 151. The intake bracket may be made of metal or any other suitable material and may be shaped to substantially conform to the shape of device 100. The intake bracket may have intakes located on top of the intake bracket. The intakes may act as dispersing conduits for canisters 150, 151. Each intake may connect to an inlet. Further, the intakes may be substantially hollow to allow sufficient passage of non-limiting examples such as, pressurized liquid and air. Additionally, there may be non-impeding activating pins located in the openings of the intakes located below the intake bracket and adjacent to canisters 150, 151. The activating pins may be made of metal or any other suitable material, and may be substantially sharp or pointed, so as to be able to puncture a thin strip of metal.

Canisters 150, 151 may have a seal that contains the pressurized contents until discharge. Upon discharge, the contents of the pressurized canisters may pass through the intake feeds and into a barrel of the device directed away from the user.

In one example, there may be a can housing located at the base of the canisters. The can housing may be a polymer or any other suitable material. This can housing may be flat on the bottom, with a plurality of cavities that may be substantially shaped like a base portion of canisters. These cavities may be formed through a raised lip surrounding the perimeter and extending longitudinally from the bottom of the can housing. The width of the bottom and the lip of the can housing may be sufficient to provide support and conformity to canisters.

Additionally, there may be a can flap located beneath the can housing. The can flap may be substantially rectangular with an can engaging section and a trigger stick section. The can flap may be a polymer, metal or any other suitable material. These two portions may make up substantially half each of can flap. Furthermore, there may be two cylindrical pegs in the middle that may act as fulcrum to the can flap lever. Additionally, trigger stick section may have a substantially depressed cavity located at the distal end and may have dimensions similar to the bottom of trigger stick.

Also, the trigger stick may be located adjacent to the canister, below the trigger, and within the depressed cavity of the can flap. The trigger stick may be substantially rectangular until the top, which may end in a cylindrical trigger pin. Moreover, the trigger stick may be a metal, polymer, or any other suitable material. Upon depression of the trigger, trigger pin may be engaged by the trigger driving the trigger stick downwards, which may push the trigger stick section of the can flap down causing the can engaging section to push up on the bottom of the can housing.

The top of the trigger may have a cylindrical empty space that may allow the trigger to couple with a cylindrical rotation pin. A rotation pin may allow the trigger to be depressed with the force of human finger.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A portable multi-use self-defense device, comprising:

a trigger with a slide pin;

two or more canisters each having a valve, said canisters containing at least one of gas and liquids; and an engagement mechanism coupled to said trigger and to said canisters, said engagement mechanism being capable of actuating the discharge of the at least one of gas and liquids from the valves of the two or more canisters substantially simultaneously, wherein the engagement mechanism comprises:

a plate with a diagonal slot which receives the slide pin of the trigger; and a pull up bar with a first end coupled to a bottom of the plate, and a second end coupled to an underside of the two or more canisters, wherein when the trigger is moved back, the slide pin moves within the diagonal slot moving the plate, pull-up bar, and two or more canisters in an upward direction, actuating the valves to discharge the at least one of gas and liquids from the two or more canisters.

2. The multi-use self-defense device of claim 1, wherein the at least one of gas and liquids are compressed.

3. The multi-use self-defense device of claim 1, wherein said two or more canisters each includes a valve, said valves actuating the release of the contents of said two or more canisters upon compression.

4. The multi-use self-defense device of claim 1, wherein at least one of the canisters contains pepper spray.

5. The multi-use self-defense device of claim 4, wherein the pepper spray is dyed orange.

6. The multi-use self-defense device of claim 1, further comprising a light.

7. The multi-use self-defense device of claim 6, wherein the light comprises a lamp, a control switch, and a power source.

8. The multi-use self-defense device of claim 6, wherein the engagement mechanism is capable of activating the light and actuating the release of the at least one of gas and liquids from the two or more canisters substantially simultaneously.

9. The multi-use self-defense device of claim 1, further comprising a housing.

10. The multi-use self-defense device of claim 9, wherein the housing includes a barrel and said barrel includes one or more nozzles at the distal end of said barrel.

11. The multi-use self-defense device of claim 10, wherein said barrel gradually increases in diameter toward said one or more nozzles.

12. The multi-use self-defense device of claim 9, wherein the housing includes a grip contoured to fit a user's hand.

13. The multi-use self-defense device of claim 9, wherein the housing is comprised of two sides.

14. The multi-use self-defense device of claim 13, wherein said sides are coupled to each other.

* * * * *